US006443767B1

(12) United States Patent
Nagai

(10) Patent No.: US 6,443,767 B1
(45) Date of Patent: Sep. 3, 2002

(54) CONNECTOR WITH INTEGRAL COVER

(75) Inventor: Kentaro Nagai, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/575,725

(22) Filed: Aug. 4, 2000

(30) Foreign Application Priority Data

Aug. 6, 1999 (JP) ..... 11-224184

(51) Int. Cl.[7] ..... H01R 9/05
(52) U.S. Cl. ..... 439/596
(58) Field of Search ..... 439/594, 595, 439/596, 701, 717, 350, 354, 466, 752

(56) References Cited

U.S. PATENT DOCUMENTS 4,413,872 A * 11/1983 Rudy et al. ..... 439/596
5,643,009 A * 7/1997 Dinkel et al. ..... 439/595
5,700,162 A * 12/1997 Hatagishi et al. ..... 439/752
5,803,773 A * 9/1998 Kashiyama et al. ..... 439/752
5,827,093 A * 10/1998 Okabe ..... 439/752
5,967,842 A * 10/1999 Okabe ..... 439/596
5,967,843 A * 10/1999 Okabe et al. ..... 439/596
5,997,365 A * 12/1999 Abe ..... 439/752
6,000,971 A * 12/1999 Hatagishi et al. ..... 439/701
6,027,374 A * 2/2000 Nagai et al. ..... 439/596

FOREIGN PATENT DOCUMENTS

JP 8-158919 7/1996

* cited by examiner

*Primary Examiner*—Renee Luebke
*Assistant Examiner*—Briggitte Hammond
(74) *Attorney, Agent, or Firm*—Finnegan, Henderson, Farabow, Garrett, & Dunner, L.L.P.

(57) ABSTRACT

In a connector with an integral cover in which a cover (13) is provided continuously with a housing body (12) via a returning hinge (17), in a region near a pivot point rotation via the returning hinge (17) a holding hinge (18) is provided, wherein the cover is temporarily held to the housing body (12) in the opened condition, and wherein forcible deformation is done to use the returning hinge (17) to allow movement of the cover (13) to a close position. Housing parts each housing the returning hinge (17) and holding hinge (18) when the cover (13) is closed are provided on the housing body (12).

9 Claims, 8 Drawing Sheets

CONNECTOR WITH INTEGRAL COVER

BACKGROUND OF THE INVENTION

1. Field of the Invention

The present invention relates to a connector with an integral cover, in which a housing body having a terminal accommodation chamber has a cover continuously and integrally provided thereto via a displaceable or flexible hinge and configured to close an opening formed in the housing body.

2. Description of the Related Art

FIG. 5A and FIG. 5B show the configuration of a connector with an integral cover (rear holder) disclosed in Japanese Patent Application Laid-Open Publication No. 8-185919. A housing 1A of a connector 1 is formed, at each of the upper and lower sides, by an enclosure or housing body 2 and a cover 3. Terminal accommodation chambers 4 are provided in the housing body 2, in which metallic terminals 5 are accommodated. An opening 6 is provided in the rear half of a top wall of the housing body 2 to allow operational access to the metallic terminals 5 in the terminal accommodation chambers 4 to enable, for example, insulation displacement connection of insulated electric wires W to the terminals 5. The opening 6 can be covered by the cover 3 that is provided continuously with the housing 2 via a flexible band-shaped hinge 7.

In the above-noted configuration, to facilitate holding of the cover 3 to the housing body 2, the flexible hinge 7 is formed thin and soft, so that its own force of repulsion does not hinder the task of holding the cover 3. It however is impossible to maintain the cover 3 in an open position with good stability using just the soft flexible hinge 7, and a temporary holding piece 8 is provided at a front end part of the housing body 2, distanced from the flexible hinge 7, to temporarily hold the cover 3 in the open position.

After connection of the electric wires W to the metallic terminals 5, when covering the opening 6 with the cover 3, as shown in FIG. 5B, the temporary holding piece 8 is cut away, to make the cover 3 free to move. In this condition, the flexible hinge 7 has a tendency to urge the cover 3 to swing toward a close position.

In the above-noted connector of the past, when cutting away the temporary holding piece 8, an undue force might be imposed on the soft flexible hinge 7, with the fear of deforming or damaging the flexible hinge 7. Additionally, cut parts of the temporary holding piece 8 are left projecting outside the housing 1A, constituting a hindrance when fitting the connector with a mating connector.

SUMMARY OF THE INVENTION

The present invention has been made with such points in view. It therefore is an object of the present invention to provide a connector with an integral cover in which the cover can be held in an open position, without using a temporary holding piece.

An aspect of the present invention to achieve the object is a connector with an integral cover, comprising an enclosure enclosing a terminal accommodation chamber, the enclosure being formed with an opening for access to the terminal accommodation chamber, a cover to close the opening, and a flexible hinge joining the cover to the enclosure, the flexible hinge having a tendency to hold the cover in an open position relative to the opening.

According to this aspect, the flexible hinge holds the cover open to allow access to the terminal accommodation chamber.

Another aspect of the present invention to achieve the object is a connector with an integral cover, in which a housing body having a terminal accommodation chamber has a cover continuously and integrally provided thereto via a flexible hinge and configured to close an opening formed in the housing body, wherein a holding hinge is provided in a vicinity of a pivot point of rotation of the cover by the flexible hinge, for temporarily holding the cover in an open position thereof on the housing body and to be forcibly deformed to allow for the cover to be moved to a close position by means of the flexible hinge.

According to this aspect, as a holding hinge for temporarily holding the cover is provided in a vicinity of the pivot point on which the cover is rotatable by the flexible hinge, even without cutting away the holding hinge, it is possible by merely forcibly deforming the holding hinge, thereby allowing rotation of the flexible hinge, to move the cover to the close position while using the flexible hinge.

BRIEF DESCRIPTION OF THE DRAWINGS

The above-noted and other features of the present invention will be apparent from the description of embodiments to follow, taken in combination with the accompanying drawings, in which.

DETAILED DESCRIPTION OF THE PREFERRED EMBODIMENTS

Embodiments of the present invention are described in detail below, with references being made to relevant accompanying drawings.

Figure 1A:
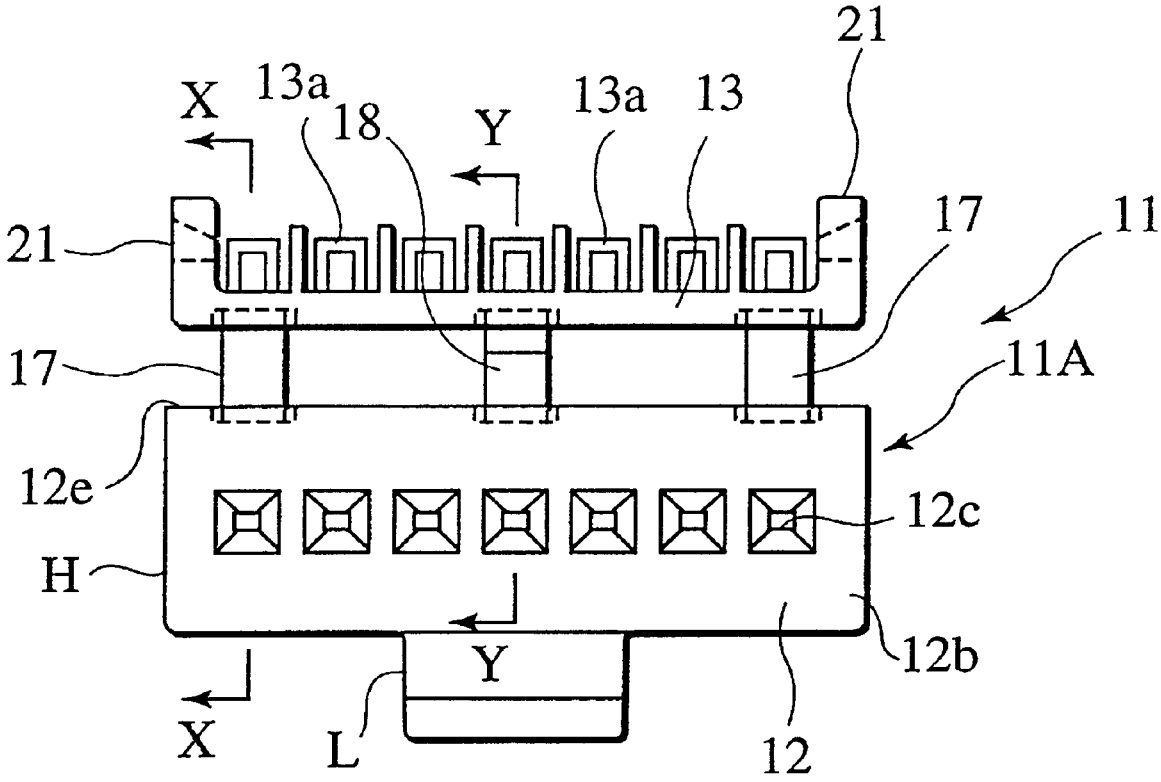
FIG. 1A is a front elevation of a connector with an integral cover according to an embodiment of the present invention.
Figure 1B:
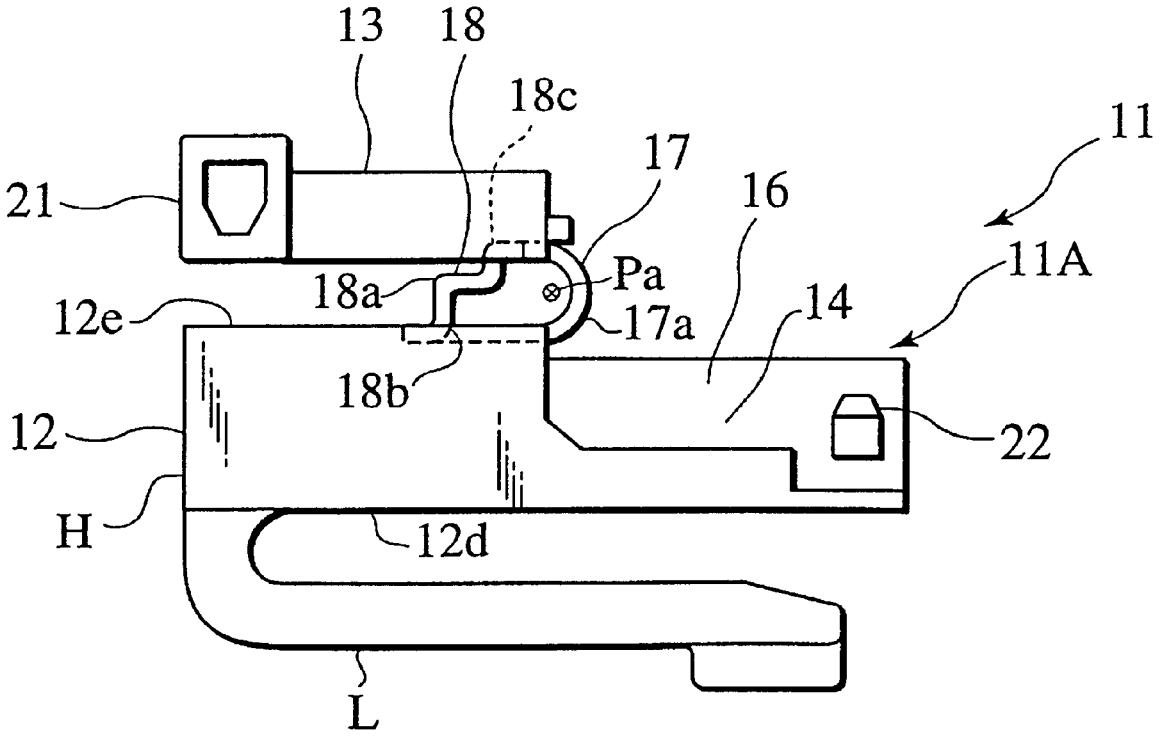
FIG. 1B is a side elevation of the connector shown in FIG. 1A.

FIGS. 1A, 1B, 2A, 2B and 3 show a connector 11 integrally formed with a rear cover 13 according to an embodiment of the present invention. The connector 11 includes a connector housing 11A and a plurality of metallic terminals (not shown) connected to insulated electric wires (not shown) and housed in the housing 11A. The metallic terminals are fixed in their positions by engagement with top holes 12*a* formed in the housing 11A as in FIG. 3. As shown in FIG. 1A, the connector housing 11A has in its front side 12*b* a plurality of terminal insertion holes 12*c* for insertion of mating terminals of a mating connector (not shown) to be connected to the metallic terminals. As shown in FIG. 1B, the connector housing 11A is formed by a rectangular main housing H, and a flexible locking arm L rearwardly extending from a front end of a bottom 12*d* of the main housing H. The locking arm L is engageable with a hole in a hood portion (not shown) of the mating connector.

Figure 2A:
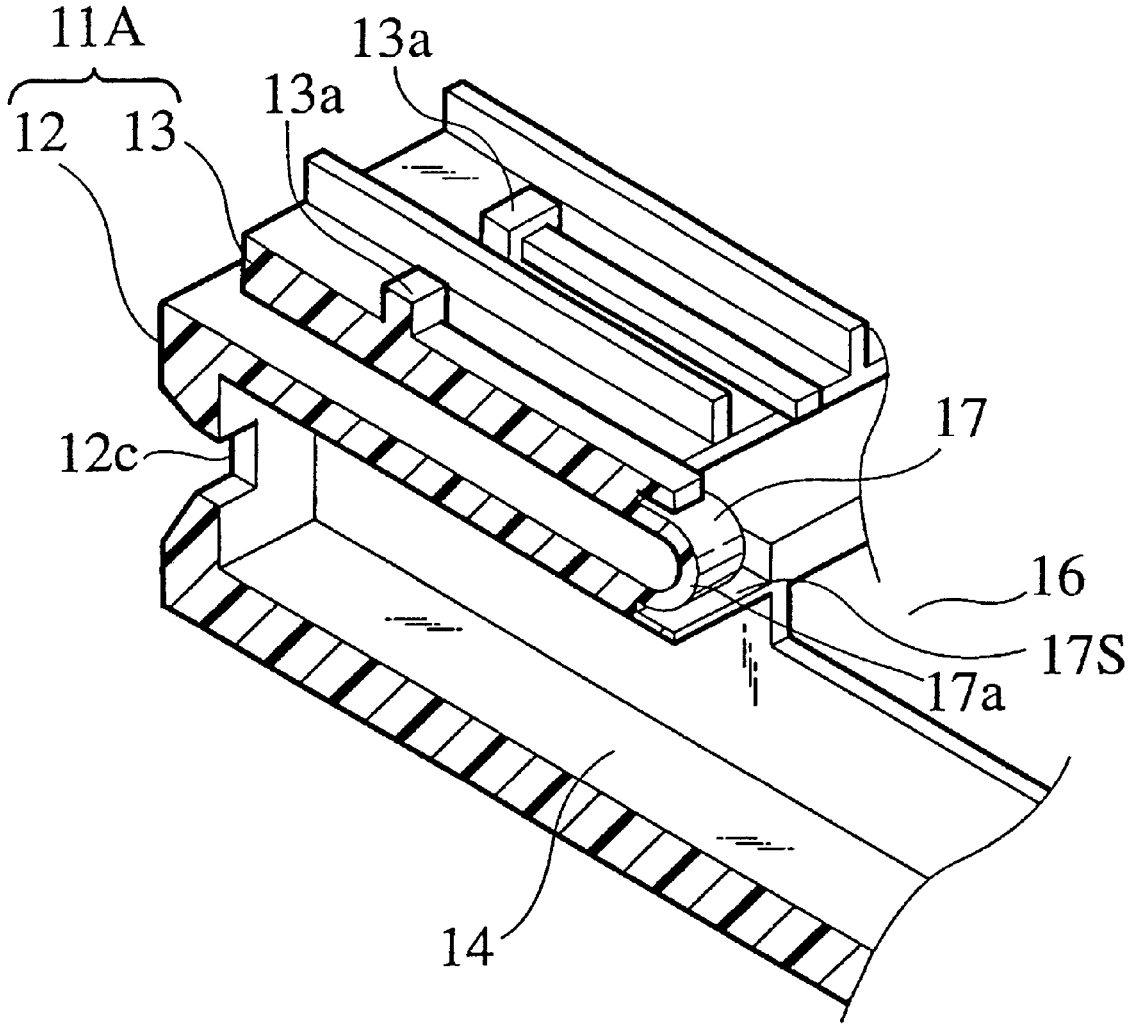
FIG. 2A is an X—X cross-sectional view of the connector shown in FIG. 1A.
Figure 2B:
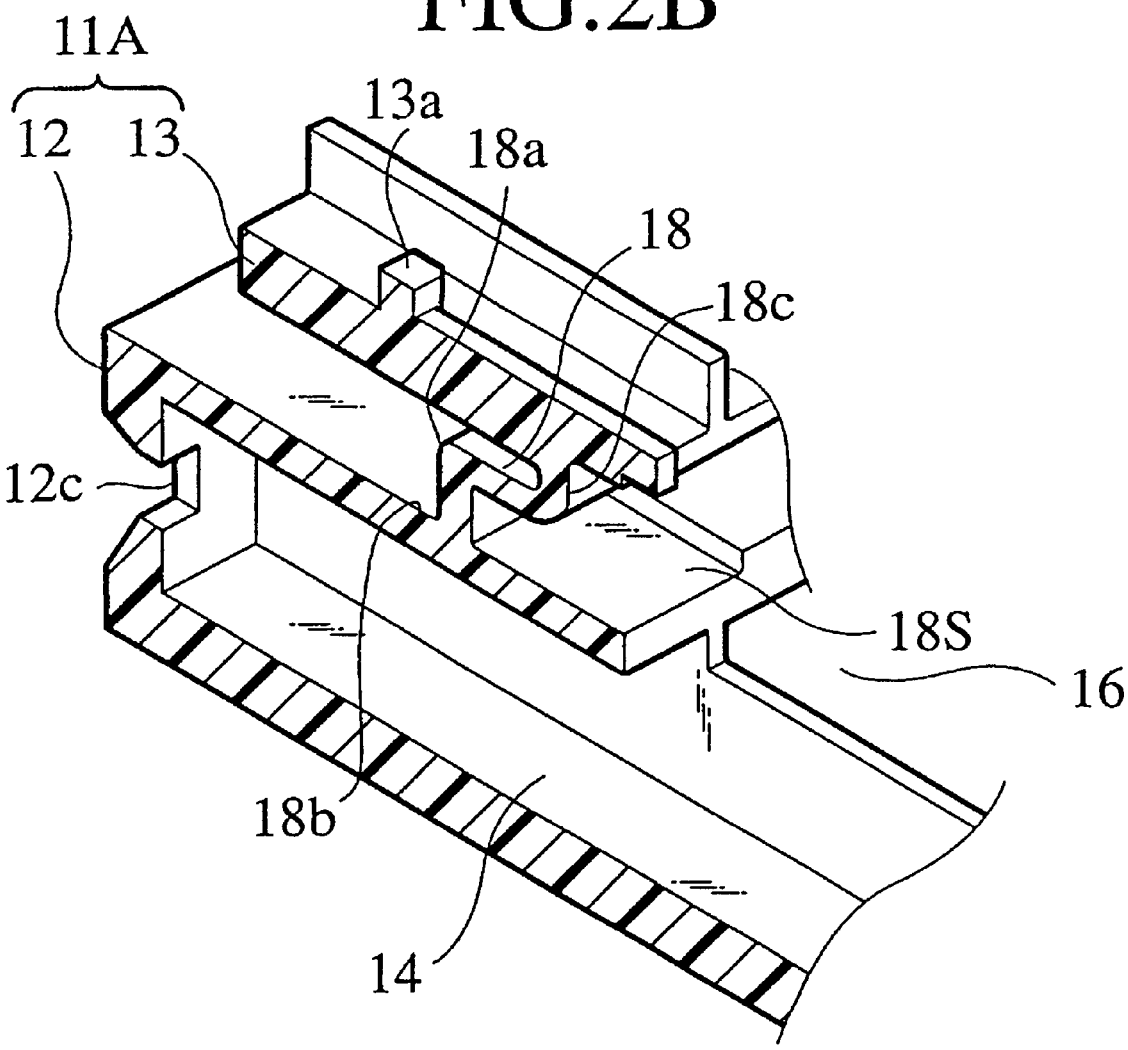
FIG. 2B is a Y—Y cross-sectional view of the connector shown in FIG. 1A.
Figure 3:
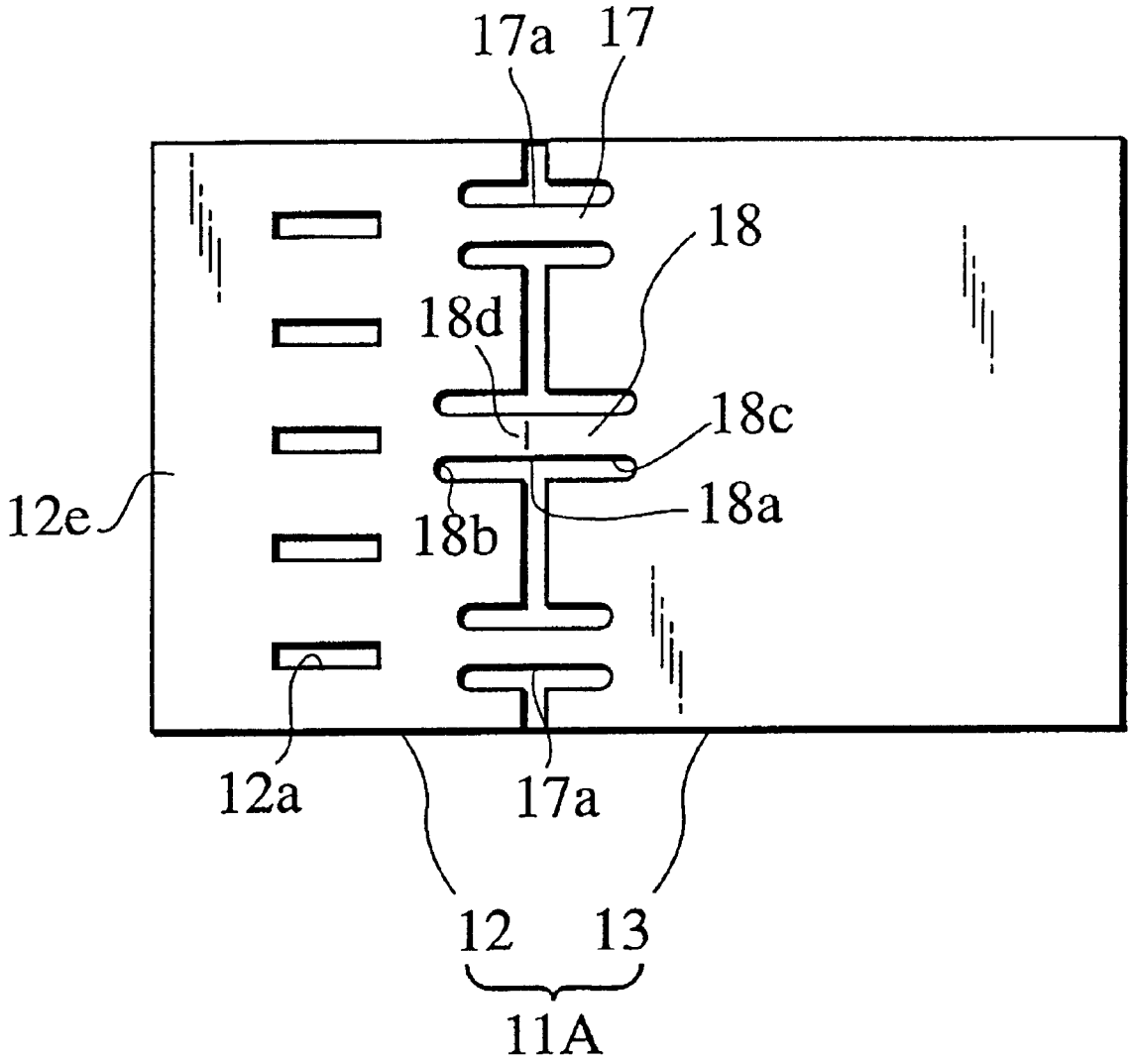
FIG. 3 is a plan view of the connector shown in FIG. 1A, with the cover in a closed condition.

As shown in FIGS. 1A and 1B, the main housing H comprises: a rectangular housing body 12 (or enclosure), which has a plurality of terminal accommodation chambers 14 (see FIGS. 2A and 2B) defined therein and a common rear opening 16 communicating with the accommodation chambers 14 and rearwardly and upwardly open; and a rear cover 13 configured to fit in the opening 16. The housing body 12 is provided as a hollow body of synthetic resin, together with the rear cover, 13. The rear opening 16 is formed in a rear half of an upper wall 12*e* of the housing body 12, and the cover 13 is configured to cover over the opening 16. As shown in FIG. 3, the cover 13 is connected to the housing body 12, by a combination of a pair of returning flexible hinges (hereafter each respectively simply called "returning hinge") 17 and a single holding flexible hinge (hereafter simply called "holding hinge") 18, which are arranged at a front edge part of the opening 16, as illustrated in FIGS. 2A and 2B. In this embodiment, as shown in FIG. 1A and FIG. 3, the holding hinge 18 is disposed at a central part in a transverse direction (i.e. the left-to-right direction in FIG. 1A) of the housing body 12, with the returning hinges 17 disposed at the left and right. The housing body 12 and the cover 3, as well as the hinges 17 and 18, are integrally molded with a synthetic resin.

The opening 16 is provided, for example, to permit an access for automatic wire connection, such as insulation displacement connection of insulated electric wires (not shown) onto the metallic terminals (not shown) housed in the terminal accommodation chambers 14 of the housing body 12. After completion of the wire connection, the cover 13 is rotated, with a necessary external force, from an open position (relative to the opening 16), where it extends along the front half of the upper wall 12*e* of the housing body 12 as illustrated in e.g. FIG. 1B, to a close position (relative to the opening 16), where it joins with the housing body 12, that is, it just fits in the opening 16, blocking an entire open area of the opening 16, having a flush outside, as is apparent from FIG. 3. In the locking condition, the cover 13 is locked to the housing body, by left and right sets of locking elements 21 and 22, which are formed either as a locking projection (22) on a lateral inside of the opening 16 or as an engagement hole (21) in a lateral outside of the cover 13 as illustrated in FIG. 2B.

As shown in FIG. 1B and FIG. 2A, each returning hinge 17 is thin, soft, and band-shaped with even width and thickness, and can be freely bent forward in a round form about a virtual pivotal axis Pa, joining the front edge part of the opening 16 to a base end of the cover 13. In any bent form, the returning hinge 17 has a commensurate returning tendency to urge the cover 13 to rotate toward the close position. As in FIG. 1B, the cover 13 in the open position is inverted toward the front about the virtual pivotal axis Pa of the returning hinges 17, and is positioned back-to-back with respect to the upper wall 12*e* of the housing body 12 that remains at the front side of the opening 16.

As shown in FIG. 1B and FIG. 2A, each returning hinge 17 is thin, soft, and band-shaped with even width and thickness, and can be freely bent forward in a round form about a virtual pivotal axis Pa, joining the front edge part of the opening 16 to a base end of the cover 13. In any bent form, the returning hinge 17 has a commensurate returning tendency to urge the cover 13 to rotate toward the close position. As shown in FIG. 1B, the cover 13 in the open position is inverted toward the front about the virtual pivotal axis Pa of the returning hinges 17, and is positioned back-to-back with respect to the upper wall 12*e* of the housing body 12 that remains at the front side of the opening 16. After the wire connection, the holding hinge 18 in the stepped form is forcibly flexed rearward, i.e. toward the close position, thereby allowing the cover 13 to rotate about the virtual pivotal axis Pa of the returning hinges 17. As shown in FIG. 3, the returning hinges 17 and the holding hinge 18 extend substantially straight and in parallel to each other, when the cover 13 is set in the close position.

As shown in FIGS. 2A, the upper wall 12*e* of the housing body 12 has, at the rear end of the upside, relatively short recesses 17S for receiving the returning hinges 17 to be flush at its upside with the upside of the upper wall 12*e*, when the cover 13 is placed in the close position, as illustrated in FIG. 3. Further, as shown in FIGS. 2B, the upper wall 12*e* has, at the rear end of the upside, a relatively long recess 18S for receiving the holding hinge 18 to be flush at its upside with the upside of the upper wall 12*e*, when the cover 13 is placed in the close position.

There will be described functions of the embodiment.

When assembling the cover-integrated connector 11, the metallic terminals are set into the terminal accommodation chambers 14 of the housing body 12, and the insulated electric wires are connected to each metallic terminal. Next, while forcibly deforming the holding hinge 18, the returning hinges 7 are used to rotate the cover 13 to the close position at which it covers over the opening 16. When this is done, the central folding part 18*a* of the holding hinge 18 passes by the virtual pivotal axis Pa of the returning hinges 17, like a toggle, so that the cover 13 is allowed to rotate simply by forcible deformation, without cutting away the holding hinge 18.

When the cover 13 is rotated to the close position, the locking elements 21 provided at rear ends of left and right sides of the cover 13 are engaged with the locking elements 22 provided at rear ends of left and right sides of the housing body 12, thereby completing the task of assembling the cover 13. By fixing the cover 13 to the housing body 12, not only are the metallic terminals housed in the housing body 12 and protected from undue external forces, but also prevention is achieved of upward floating of the metallic terminals, as the cover 13 has protrusions (see FIGS. 2A and 2B) formed on its inner wall for pressing the electric wires and the metallic terminals.

As the cover 13 in the close position, the returning hinges 17 and the holding hinge 18 are received in the recesses 17S and 18S, the hinges 17 and 18 do not protrude outward from the connector housing 11A, so that they do not interfere with connection to a mating connector, for example.

Figure 4:
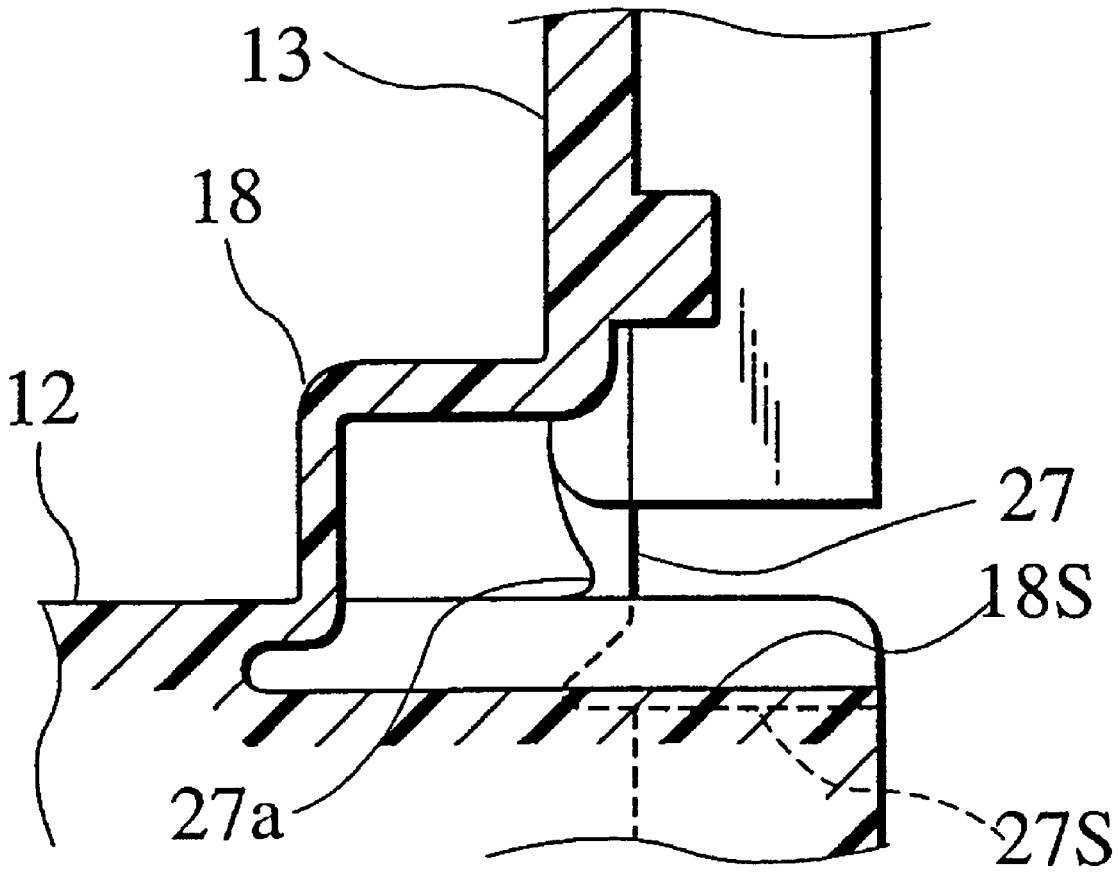
FIG. 4 is a partial side cross-sectional view of another embodiment of the present invention.
Figure 5A:
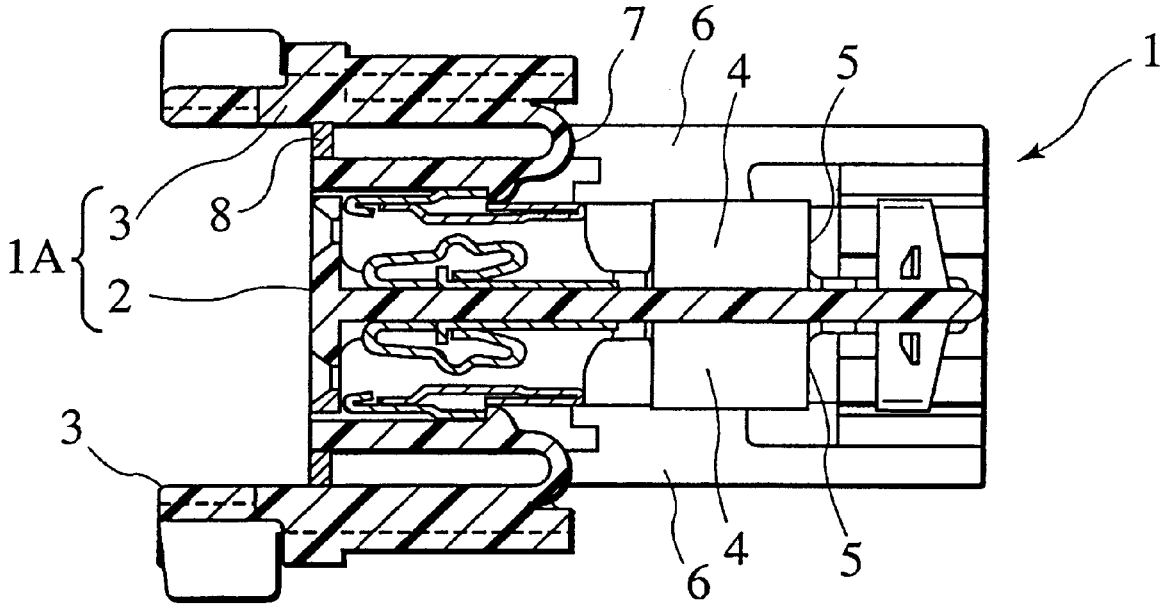
FIG.5A PRIOR ART
FIG. 5A and FIG. 5B are side cross-sectional views of a conventional connector with an integral cover, with FIG. 5A showing a condition in which the cover is open, and FIG. 5B showing a condition in which a temporary holding piece is cut away, enabling the cover to rotate.
Figure 5B:
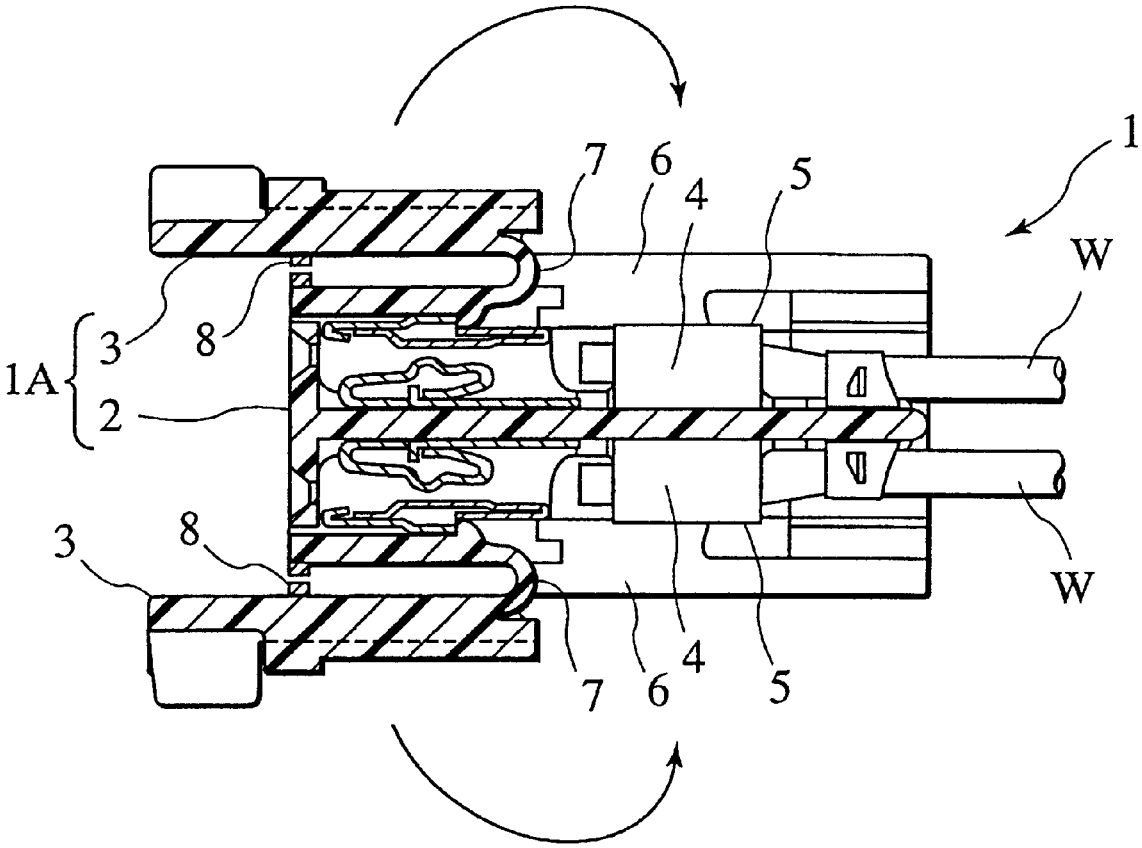
FIG.5B PRIOR ART

FIG. 4 is a partial cross-sectional view of an essential portion of a connector with an integral cover according another embodiment of the present invention.

This embodiment employs forwardly foldable returning hinges 27 different from the band-shaped bendable returning hinges 17, having a holding hinge 18 disposed therebetween. Each foldable returning hinge 27 is formed as a sheet with an even width by making a thin, weakened part 27*a* midway therein, so that the returning hinge 27 can be freely folded at the weakened part 27*a*. The configuration of the holding hinge 18 is the same as the previous embodiment. In this embodiment also, recesses 18S and 27S are provided to receive the holding hinge 18 and the returning hinges 27, respectively, 8 when a cover 13 is in its close position.

As each returning hinge 27 can fold at the thin, weakened part 27*a*, when compared with the previous embodiment which employs the bendable band-shaped returning hinges 17, this embodiment allows for the returning hinges 27 to have a clear pivotal axis established in position with a reduced deviation, so that effect of the positional restriction can be made use of in return of the cover 13 to be free from positional deviations, while rotation of the cover 13 is subjected to less freedom than in the previous embodiment.

While the present invention has been described using specific terms, such description is for illustrative purposes, and it is to be understood that changes and variations may be made without departing from the spirit or scope of the following claims.

What is claimed is:

1. A connector with an integral cover comprising an enclosure enclosing a terminal accommodation chamber, the enclosure being formed with an opening for access to the terminal accommodation chamber, the cover to close the opening, a first flexible hinge joining the cover to the enclosure, the first flexible hinge having a tendency to hold the cover in an open position relative to the opening, and a second flexible hinge joining the cover to the enclosure, the second flexible hinge being provided in a vicinity of a pivot point of rotation of the cover for temporarily holding the cover in the open position and to be forcibly deformed without being cut to allow the cover to be moved to a close position by means of the first flexible hinge.

2. The connector with an integral cover according to claim 1 wherein the first and second flexible hinges are flexed opposite to each other to have the first and second tendencies, respectively, when the cover is in the open position.

3. The connector with an integral cover according to claim 2 wherein the first and second flexible hinges are extended substantially parallel to each other, when the cover is in the close position.

4. The connector with an integral cover according to claim 3 wherein the enclosure is formed with recesses to receive the first and second flexible hinges when the cover is in the close position.

5. A connector with an integral cover in which a housing body having a terminal accommodation chamber has the cover continuously and integrally provided thereto via a flexible hinge and configured to close an opening formed in the housing body, wherein a holding hinge is provided in a vicinity of a pivot point of rotation of the cover by the flexible hinge for temporarily holding the cover in an open position thereof on the ho using body and to be forcibly deformed without being cut to allow the cover to be moved to a close position by means of the flexible hinge.

6. The connector with an integral cover according to claim 5 wherein housing parts are provided for housing the flexible hinge and the holding hinge when the cover is moved to the close position.

7. A connector with an integral cover comprising:

an enclosure enclosing a terminal accommodation chamber, the enclosure being formed with an opening for access to the terminal accommodation chamber, the cover to close the opening, a holding flexible hinge joining the cover to the enclosure, wherein the holding flexible hinge is provided in a vicinity of a pivot point of rotation of the cover for temporarily holding the cover in an open position, and a first returning flexible hinge joining the cover to the enclosure, the first returning flexible hinge having a tendency to urge the cover toward a close position relative to the opening, wherein the holding flexible hinge is capable of being forcibly deformed without being cut to allow the cover to be moved to the close position by means of the first returning flexible hinge.

8. The connector with an integral cover according to claim 7 further comprising a second returning flexible hinge, the second returning flexible hinge joining the cover to the enclosure and having a tendency to urge the cover toward the close position relative to the opening.

9. The connector with an integral cover according to claim 8 wherein the enclosure is formed with recesses to receive the flexible holding hinge and the first and second returning flexible hinges when the cover is in the close position.

* * * * *

UNITED STATES PATENT AND TRADEMARK OFFICE

CERTIFICATE OF CORRECTION

PATENT NO. : 6,443,767 B1
DATED : September 3, 2002
INVENTOR(S) : Kentaro Nagai

It is certified that error appears in the above-identified patent and that said Letters Patent is hereby corrected as shown below:

Column 6,
Line 4, “ho using” should read -- housing --.

Signed and Sealed this

Fourth Day of February, 2003

JAMES E. ROGAN
*Director of the United States Patent and Trademark Office*